US007583910B2

(12) United States Patent
Matsumoto et al.

(10) Patent No.: US 7,583,910 B2
(45) Date of Patent: Sep. 1, 2009

(54) IMAGE FORMING APPARATUS

(75) Inventors: Daisuke Matsumoto, Osaka (JP); Satoshi Takahashi, Osaka (JP)

(73) Assignee: Kyocera Mita Corporation (JP)

( * ) Notice: Subject to any disclaimer, the term of this patent is extended or adjusted under 35 U.S.C. 154(b) by 178 days.

(21) Appl. No.: 11/974,698

(22) Filed: Oct. 15, 2007

(65) Prior Publication Data

US 2008/0260409 A1 Oct. 23, 2008

(30) Foreign Application Priority Data

Oct. 16, 2006 (JP) ..... 2006-281659

(51) Int. Cl.
*G03G 15/20* (2006.01)

(52) U.S. Cl. ..... 399/69; 399/88

(58) Field of Classification Search ..... 399/38, 399/67, 69, 70, 75, 88, 122, 320
See application file for complete search history.

(56) References Cited

U.S. PATENT DOCUMENTS

2008/0204814 A1* 8/2008 Nishi ..... 358/296

FOREIGN PATENT DOCUMENTS

JP 10-282821 10/1998

* cited by examiner

*Primary Examiner*—Hoan H Tran
(74) *Attorney, Agent, or Firm*—Gerald E. Hespos; Anthony J. Casella

(57) ABSTRACT

When the temperature of a fixing roller detected by a temperature detecting section is less than a predetermined fixing temperature, and a determining portion determines that an image forming unit forms a color image, a control portion stops electric power supply from an electric double layer capacitor to a second fixing heater and allows a commercial power source to supply electric power to a first fixing heater to heat the fixing roller. When the determining portion determines that the image forming unit forms a monochromatic image, the control portion allows the commercial power source to supply electric power to the first fixing heater to heat the fixing roller and allows the electric double layer capacitor to supply electric power to the second fixing heater to heat the fixing roller.

8 Claims, 5 Drawing Sheets

IMAGE FORMING APPARATUS

BACKGROUND OF THE INVENTION

1. Field of the Invention

The present invention relates to an image forming apparatus. More particularly, it relates to a control of allowing an external power source, such as a commercial power source or the like, and an additional auxiliary power source to supply electric power to a fixing heater to heat a fixing section.

2. Description of the Related Art

There has been an image forming apparatus, such as a copying machine, in which both a commercial power source and an auxiliary power source (for example, an electric double layer capacitor) apply a high current to a fixing heater to heat a fixing roller such that a length of time taken for raising the temperature of the fixing roller to a predetermined fixing temperature is shortened when the image forming apparatus is in an initial stage of starting up or when the image forming apparatus is restored form an energy-saving mode of suspending an electric power supply to the fixing heater and waiting for a printing operation (refer to Japanese Patent Unexamined Publication No. 10-282821). According to such image forming apparatus in which both the commercial power source and the auxiliary power source supply electric power to drive the fixing heater, the temperature of the fixing roller is raised in a short period of time, and the fixing roller is allowed to wait at a low temperature in the energy-saving mode. Accordingly, it is effective for saving electric power.

However, in such image forming apparatus described above, both the commercial power source and the auxiliary power source always apply a high current to the fixing heater to heat the fixing roller when the image forming apparatus is in an initial stage of starting up or restores from the energy-saving mode. Therefore, an effect of saving an electric power can be obtained in view of overall consumption of electric power for driving the image forming apparatus. However, in view of focusing only on energy consumption in the initial stage of starting up or restoration from the energy-saving mode, consumption of electric power becomes greater than the case where only the commercial power source supplies electric power to drive the fixing heater. Further, the number of times of charging and discharging an auxiliary power source composed of an electric double layer capacitor increases, and this increase causes a problem of a negative effect on a life of the auxiliary power source.

SUMMARY OF THE INVENTION

The present invention has been worked out in view of the above-described problem, and it shortens the length of time taken for raising the temperature of the fixing section to a predetermined fixing temperature and further saves consumption of electric power to extend a life of the auxiliary power source to be longer than a conventional life.

In other words, the present invention includes an image forming apparatus, comprising: an image forming section for forming a color image and a monochromatic image by providing a toner image to a recording sheet; a fixing section for fixing the toner image on the recording sheet at a predetermined fixing temperature; a temperature detector for detecting a temperature of the fixing section; an auxiliary power source for auxiliarily supplying electric power to heat the fixing section, the auxiliary power source being charged with electric power supplied from a commercial power source; a heating portion for heating the fixing section, the heating portion including: a first fixing heater for heating the fixing section by electric power supplied from the commercial power source; and a second fixing heater for heating the fixing section by electric power supplied from the auxiliary power source; a determining section for determining which of a color image and a monochromatic image the image forming section forms; and a controller for controlling electric power supply to the heating portion. When the temperature of the fixing section detected by the temperature detector is less than the predetermined fixing temperature, the controller allows the auxiliary power source to stop supplying electric power to the second fixing heater and allows the commercial power source to supply electric power to the first fixing heater to heat the fixing section when the determining section determines that the image forming section forms a color image, and the controller allows the commercial power source to supply electric power to the first fixing heater to heat the fixing section and allows the auxiliary power source to supply electric power to the second fixing heater to heat the fixing section when the determining section determines that the image forming section forms a monochromatic image.

These and other objects, features and advantages of the present invention will become more apparent upon reading of the following detailed description along with the accompanied drawings.

DETAILED DESCRIPTION OF THE PREFERRED EMBODIMENTS

Figure 1:
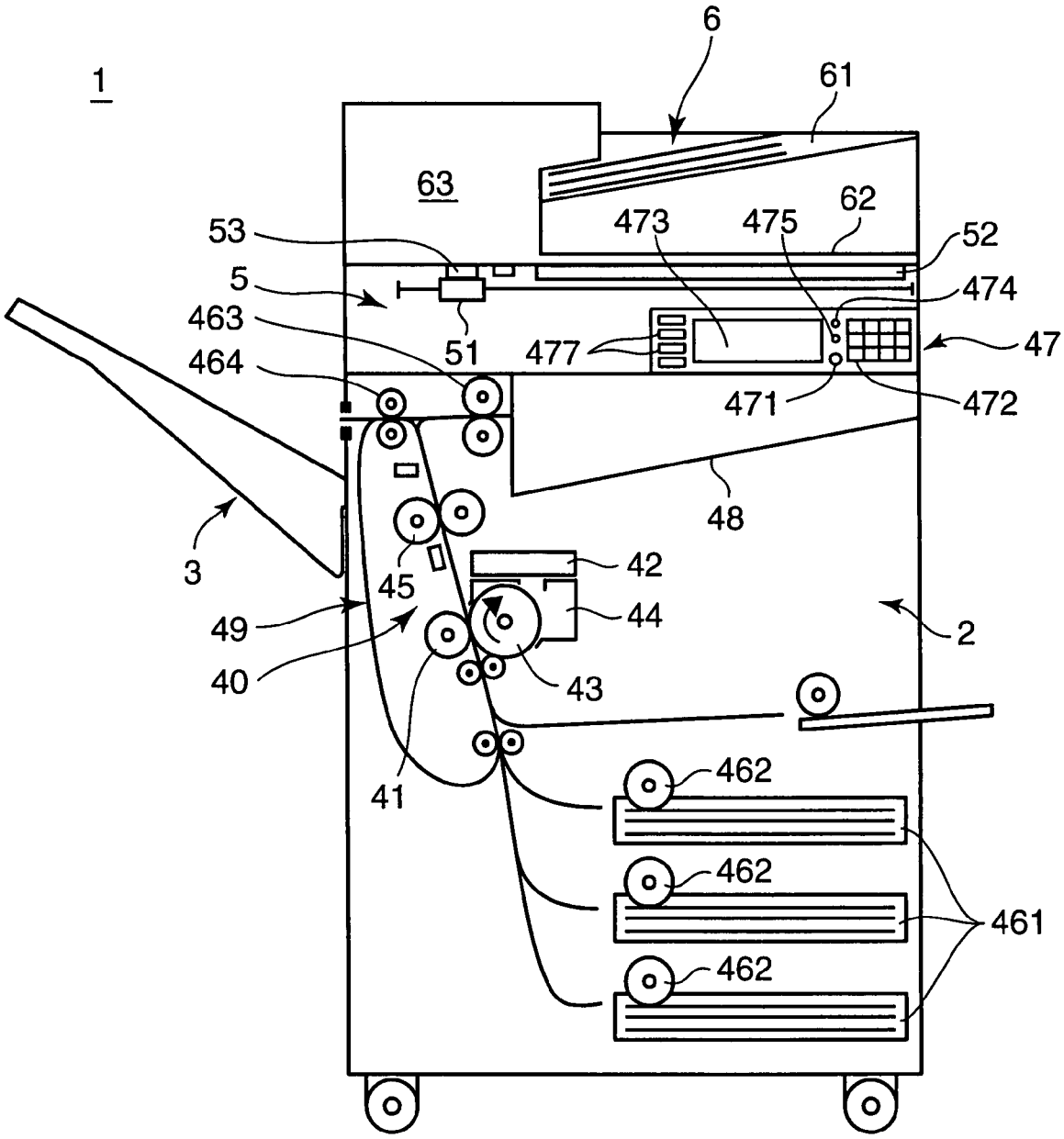
FIG. 1 is a side view schematically showing an internal configuration of a complex machine which is an example of an image forming apparatus according to an embodiment of the present invention.

Hereinafter, an embodiment of an image forming apparatus according to the present invention will be described with reference to the drawings. FIG. 1 is a side view schematically showing an internal configuration of a complex machine which is an example of an image forming apparatus according to the embodiment of the present invention. The complex machine 1 has functions such as a copying function, a printer function, a scanner function, and a facsimile function. This complex machine 1 includes a main body 2, a stack tray 3 provided on the left of the main body 2, an image reading section 5 provided in an upper portion of the main body 2, and a document-feeding section 6 arranged over the image reading section 5.

Further, on the front portion of the complex machine 1, there is provided an operating portion (instruction input section) 47. The operating portion 47 includes a start key 471 for allowing a user to input a print instruction, numerical keys 472 for allowing the user to input the number of prints and the like, a display portion 473 which displays operation guide information of various copying operations and is composed of a liquid crystal display and the like having a touch panel function for input of the various settings, a reset key 474 for resetting contents of settings which are set through the display portion 473, a stop key 475 for stopping a printing (image forming) operation under execution, and a function-switching key 477 for switching a function to a copying function, a printer function, a scanner function, and a facsimile function.

Figure 2:
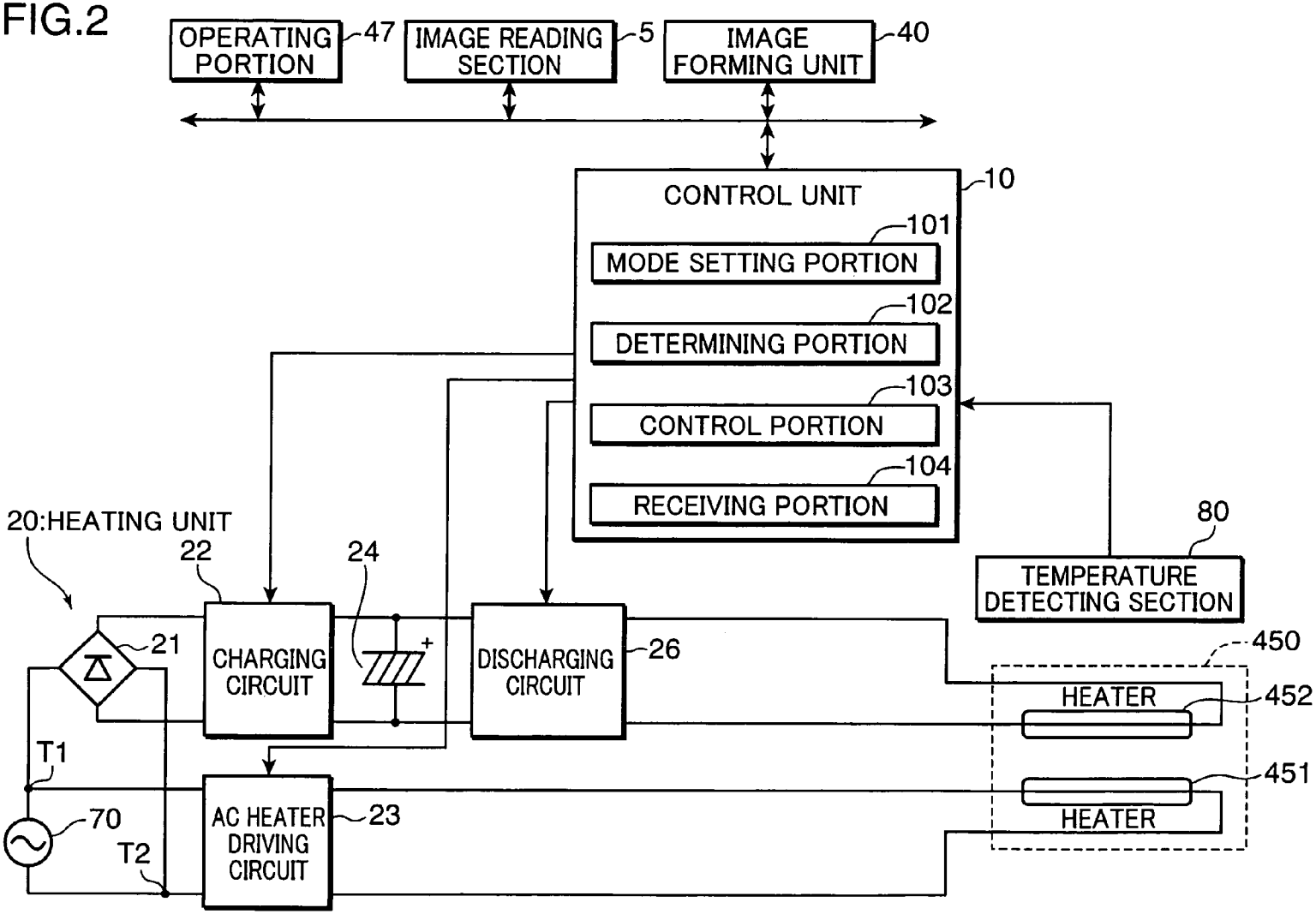
FIG. 2 is a block diagram showing a schematic configuration of the complex machine.

The image reading section (image reader) 5 includes a scanner portion 51 having a CCD (Charge Coupled Device) sensor and an exposing lamp, and a platen 52 and a document-reading slit 53 composed of a transparent member such as glass. The scanner portion 51 is movable by means of an unillustrated driving portion. When reading a document placed on the platen 52, the scanner portion 51 moves beneath the platen 52 and along a document surface to scan a document image and obtain image data, and then outputs the image data to a control portion 103 (FIG. 2). Further, when reading a document fed by the document-feeding section 6, the scanner portion 51 moves to a position facing the document-reading slit 53 to obtain an image of the document through the document-reading slit 53 in synchronization with a document-conveying operation by the document-feeding section 6, and then outputs the image data to the control portion 103.

The document-feeding section 6 includes a document-conveying mechanism 63 having a document holding portion 61 for holding a document, a document-discharging portion 62 for discharging a document whose image is read, a sheet-feeding roller (unillustrated) and a conveying roller (unillustrated) for sending documents placed on the document holding portion 61 one after another, conveying the same to a position facing the document-reading slit 53 and then discharging the document to the document-discharging portion 62. The document-conveying mechanism 63 further includes a sheet-reversing mechanism (unillustrated) for reversing sides of a document and conveying the document to a position facing the document-reading slit 53 to allow the scanner portion 51 to read images of both sides of the document through the document-reading slit 53.

Further, the document-feeding section 6 is rotatably provided to the main body 2 so that its front side can be moved upward. By moving the front side of the document-feeding section 6 upward to allow the upper surface of the platen 52 to be open, a user can place a document to be read, such as an opened book, onto the platen 52.

The main body 2 includes a plurality of sheet-feeding cassettes 461, sheet-feeding rollers 462 and an image forming unit 40. Each sheet-feeding roller 462 takes out recording sheets one after another from a respective sheet-feeding cassette 461 and conveys the recording sheets to the image forming unit 40. The image forming section forms an image on a recording sheet conveyed from the sheet-feeding cassette 461.

The image forming unit (image forming section) 40 includes an optical unit 42 for outputting laser light or the like according to the image data obtained by the scanner portion 51 to expose a photoconductive drum 43, a developing device 44 for forming a toner image on the photoconductive drum 43, a transferring device 41 for transferring the toner image formed on the photoconductive drum 43 to a recording sheet, and a fixing device (fixing section) 45 for heating the recording sheet to fix the toner image formed on the recording sheet, conveying rollers 463, 464 provided on the sheet-conveyance path in the image forming unit 40 for conveying the recording sheet to the stack tray 3 or to a discharging tray 48.

Further, when forming images on both sides of a recording sheet, an image is formed on one side of the recording sheet in the image forming unit 40, and thereafter, the recording sheet is placed pressingly between the conveying rollers 463 which are closer to the discharging tray 48. In this state, the conveying rollers 463 are rotated in reverse directions to switch back the recording sheet. The recording sheet is conveyed to the sheet-conveyance path 49 to move back to the upstream area of the image forming unit 40. Thereafter, an image is formed on the other side by the image forming unit 40, and then the recording sheet is discharged to the stack tray 3 or to the discharging tray 48.

FIG. 2 is a block diagram showing a schematic configuration of the complex machine 1. The complex machine 1 includes a control unit 10, a heating unit 20, the fixing device 45, the operating portion 47, the image reading section 5, and the image forming unit 40 (the image forming unit 40 having the fixing device 45).

The control unit 10 is composed of, for example, a CPU, a ROM, a RAM, and a dedicated hardware circuit, and totally controls the complex machine 1. The control unit 10 has a mode setting portion 101, a determining portion 102, a control portion 103, and a receiving portion 104. The heating unit 20 has a rectifying circuit 21, a charging circuit 22, an AC heater driving circuit 23, an electric double layer capacitor 24, and a discharging circuit 26.

The rectifying circuit 21 has, for example, a diode bridge circuit and a smoothing capacitor, and is connected between a power supply terminal T1 and a power supply terminal T2 of the commercial power source 70. The rectifying circuit 21 performs a full-wave rectification to the AC voltage supplied from the commercial power source 70, creates the DC voltage by smoothing the AC voltage to which the full-wave rectification is performed, and then outputs the DC voltage to the charging circuit 22.

The charging circuit 22 is composed of, for example, a DC/DC converter and raises or lowers the DC voltage outputted from the rectifying circuit 21 to a DC voltage having a level suitable for charging the electric double layer capacitor 24 to charge the electric double layer capacitor 24. Further, the charging circuit 22 starts charging the electric double layer capacitor 24 under control of the control portion 103 when the charged capacity of the electric double layer capacitor 24 is not enough immediately before the mode setting portion 101 switches an operation mode of the complex machine 1 from a normal operation mode to an electric power saving mode. The normal operation mode will be described hereinafter.

Further, the charging circuit 22 measures a voltage between terminals of the electric double layer capacitor 24. When the measured voltage between the terminals reaches a predetermined full-charge voltage value indicating that the electric double layer capacitor 24 is fully charged, the charging circuit determines that the electric double layer capacitor 24 is in a full-charge state, and shuts down supply of the DC voltage from the rectifying circuit 21 to the electric double layer capacitor 24 to protect the electric double layer capacitor 24 from overcharging. The AC heater driving circuit 23 is composed of, for example, an AC/AC converter and connected between the power supply terminals T1, T2. The AC heater driving circuit 23 converts the AC voltage from the commercial power source 70 into an AC voltage at a level suitable for driving of the first fixing heater 451 and outputs the AC voltage to the first fixing heater 451 to allow the first fixing heater 451 to generate heat.

The electric double layer capacitor (an example of the auxiliary power source) 24 is charged with the DC voltage outputted from the charging circuit 22 and outputs the charged voltage to the second fixing heater 452 to allow the second fixing heater 452 to generate heat. Generally, the electric double layer capacitor 24 has a characteristic that its performance is deteriorated by increase in internal resistance due to increase in the number of times of charging and discharging.

The discharging circuit 26 is a circuit for discharging electric power (electric load) of the electric double layer capacitor 24 and is composed of, for example, a constant-voltage circuit. The discharging circuit 26 has a function to create a constant voltage, which is at a level suitable for driving of the second fixing heater 452, with a discharging voltage outputted from the electric double layer capacitor 24 and output the constant voltage to the second fixing heater 452.

The fixing device 45 includes fixing rollers 450 having a pressing roller and a heating roller, and includes a heating portion having a first fixing heater 451 and a second fixing heater 452 for heating the heating roller. The first fixing heater 451 is a heater which is driven by electric power supplied from the commercial power source 70. The second fixing heater 452 is a heater driven by electric power which is stored in the electric double layer capacitor 24 and supplied by discharging of the electric double layer capacitor 24.

The control unit 10 will be described. The mode setting portion 101 is adapted to set an operation mode of the complex machine 1. The operation mode includes a normal operation mode and an electric power saving mode. The normal operation mode is a mode which enables the complex machine 1 to perform normal operations, such as a document reading operation performed by the image reading section 5 in the complex machine 1 and an image forming operation performed by the image forming unit 40 to form an image of the read document or print data received by the receiving portion 104 from a personal computer. The electric power saving mode is a mode which makes consumption of electric power of the complex machine 1 be lower than the consumption in the normal operation mode by restricting the normal operation of the complex machine 1. Such restriction to the normal operation of the complex machine 1 is achieved by shutting down of electric power supply to some of units constituting the complex machine 1. For example, heating of the fixing roller 450 by the first fixing heater 451 and second fixing heater 452 in the fixing device 45 is suspended, and/or a backlight of the display portion 473 in the operating portion 47 is turned off.

When the operation mode is set to be the normal operation mode and the operating portion 47 receives no operation instruction from a user for a certain period of time, the mode setting portion 101 shifts the operation mode from the normal operation mode to the electric power saving mode. Further, when the operation mode is set to be the electric power saving mode, and the operating portion 47 receives an operation instruction from the user, the mode setting portion 101 shifts the operation mode from the electric power saving mode to the normal operation mode.

The determining portion (determining section) 102 determines which of a color image and a monochromatic image the image forming unit 40 forms. For example, when a printing operation of allowing the image forming unit 40 to form an image according to print data received from a network-connected personal computer by the receiving portion 104 is performed, the determining portion 102 analyzes control information attached to the print data transmitted from the personal computer to determine which of a color image and a monochromatic image the image forming unit 40 forms according to which of a color image forming instruction and a monochromatic image forming instruction the control information includes. Further, when a copying operation of allowing the image forming unit 40 to form an image of a document image read by the image reading section 5 is performed, the determining portion 102 determines which of a color image and a monochromatic image the image forming unit 40 forms according to a detection of which of a color image forming instruction and a monochromatic image forming instruction an instruction inputted by a user through the operating portion 47 is.

The control portion (controller) 103 is adapted to totally control operations of the complex machine 1. In particular, when the mode setting portion 101 switches the operation mode of the complex machine 1 to the normal operation mode, the control portion 103 outputs a discharge starting instruction to the discharging circuit 26 to allow the discharging circuit 26 to start discharging of the electric double layer capacitor 24. Also, when a main power supply of the complex machine 1 is turned on (when it is in an initial stage of starting up of the complex machine 1), the mode setting portion 101 sets the normal operation mode. Further, when the mode setting portion 101 switches the operation mode to the normal operation mode, and the temperature of the fixing roller 450 obtained by a temperature detecting section 80 is less than a predetermined fixing temperature (for example, 180 degrees Celsius), the control portion 103 performs the following controls. In other words, when such conditions are met, and the determining portion 102 determines that the image forming unit 40 forms a color image, the control portion 103 disallows electric power supply from the electric double layer capacitor 24 to the second fixing heater 452 and allows the commercial power source to supply electric power to the AC heater driving circuit 23 to allow the first fixing heater 451 to heat the fixing roller 450. On the other hand, when the determining portion 102 determines that the image forming unit 40 forms a monochromatic image, the control portion 103 allows the commercial power source to supply electric power to the AC heater driving circuit 23 to allow the first fixing heater 451 to heat the fixing roller 450, and controls the discharging circuit 26 to allow electric power from the electric double layer capacitor 24 to the second fixing heater 452.

The receiving portion (receiver) 104 receives print data transmitted from a personal computer connected to the complex machine 1 through a LAN (Local Area Network) or the like and control information (information such as a size of a recording sheet used for printing, both-sided printing instruction, and an image forming instruction to form a color or monochromatic image) attached to the print data.

The temperature detecting section (temperature detector) 80 is composed of a thermister or the like which detects the temperature of the fixing roller 450 in the fixing device 45 and transmits the same to the control portion 103.

Figure 3:
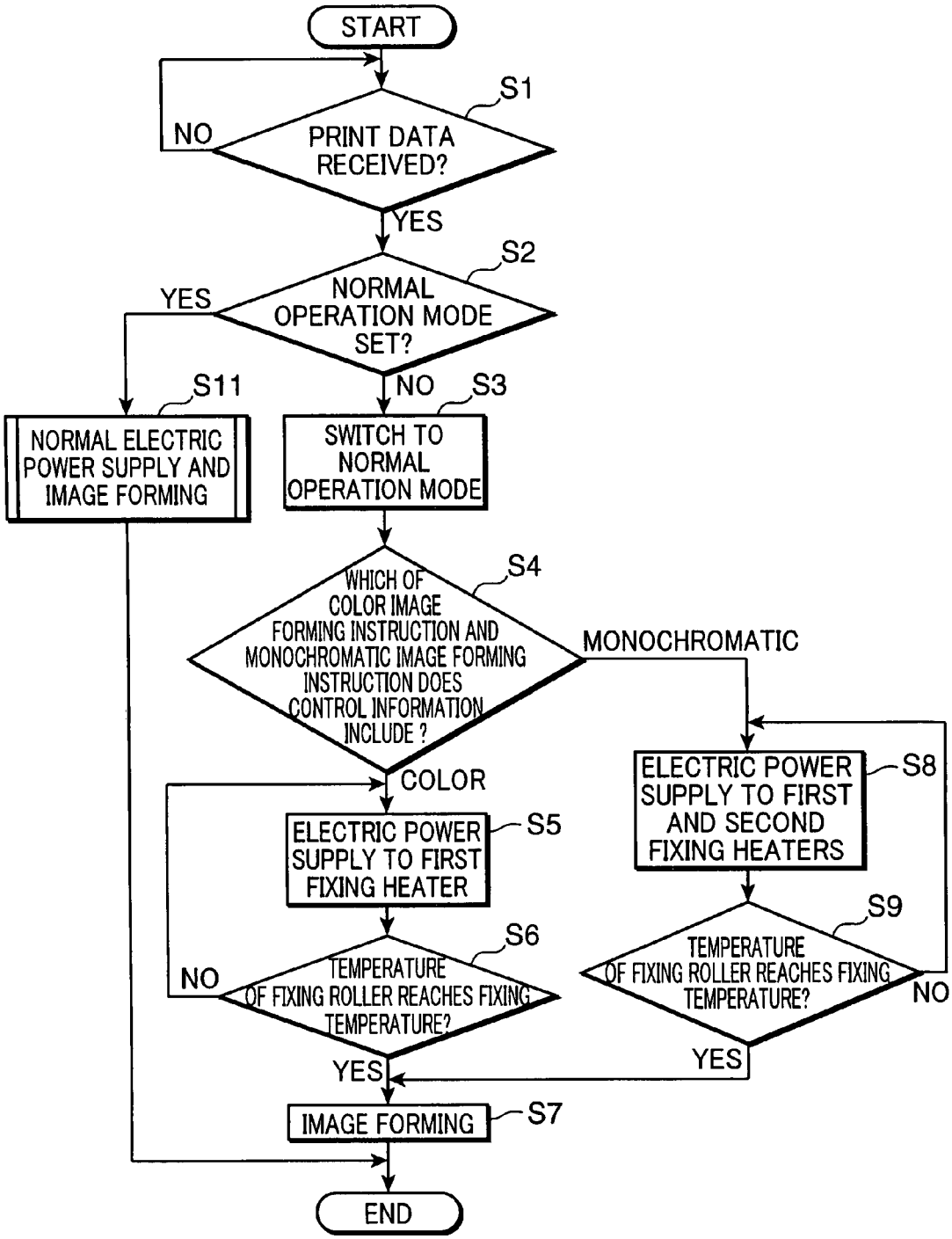
FIG. 3 is a flowchart showing a first embodiment of a control of electric power supply to a first fixing heater and a second fixing heater of the complex machine performed when an electric power saving mode is shifted to a normal operation mode.

A first embodiment (in a case of a printer operation) of a control of electric power supply to the first fixing heater 451 and the second fixing heater 452 in the complex machine 1 at the time of shifting from the electric power saving mode to the normal operation mode will be described. FIG. 3 is a flowchart showing a first embodiment of a control of electric power supply to the first fixing heater 451 and the second fixing heater 452 of the complex machine 1 performed when the electric power saving mode is shifted to the normal operation mode.

In the complex machine 1, when the receiving portion 104 receives print data from a network-connected personal computer (YES in S1), the control portion 103 determines which of the normal operation mode and the electric power saving mode the mode setting portion 101 sets at this point of time (S2). When the control portion 103 determines that the operation mode of the complex machine 1 is in the normal operation mode (YES in S2), since the temperature of the fixing roller 450 is already at the predetermined fixing temperature, the control portion 103 allows only the first fixing heater 451 to heat the fixing roller 450 and allows the image forming unit 40 to form an image according to the received print data, which are normal operation in the normal operation mode (S11).

On the other hand, when the control portion 103 determines that the operation mode of the complex machine 1 is in the electric power saving mode (NO in S2), the mode setting portion 101 switches the operation mode to the normal operation mode (S3). At this point of time, since the complex machine 1 had been in the electric power saving mode, the temperature detecting section 80 transmits temperature information, indicating the temperature of the fixing roller 450 having a predetermined temperature which is lower than the predetermined fixing temperature, to the control portion 103. Then, the determining portion 102 analyzes control information attached to the print data received by the receiving portion 104 and determines which of a color image forming instruction and a monochromatic image forming instruction the control information includes to determine which of a color image and a monochromatic image the image forming unit 40 forms (S4).

When the determining portion 102 determines that the control information includes a color image forming instruction ("COLOR" in S4), the control portion 103 allows the discharging circuit 26 to stop electric power supply from the electric double layer capacitor 24 to the second fixing heater 452 and allows the commercial power source to supply electric power to the AC heater driving circuit 23 to allow the first fixing heater 451 to heat the fixing roller 450 (S5). In other words, the heating of the fixing roller 450 with the second fixing heater 452 is not performed in this case. The electric power supply control by the control portion 103 in S5 is continued until the temperature information of the fixing roller 450 transmitted from the temperature detecting section 80 indicates reaching of the temperature of the fixing roller 450 to the predetermined fixing temperature (NO in S6). When the temperature information transmitted from the temperature detecting section 80 indicates the predetermined fixing temperature (YES in S6), the control portion 103 allows the image forming unit 40 to form an image according to the received print data (S7). When the print data is transmitted in a format of printer language data which corresponds to the complex machine 1, an image processing section (unillustrated) surely converts the printer language data to a data format with which the image forming unit 40 can form an image (for any of a color image forming and a monochromatic image forming).

This electric power supply control performed by the control portion 103 provides the following advantages. Specifically, when a color image forming which requires a calibration processing is performed, it takes a long time before the calibration processing is terminated. Therefore, even if the fixing section is started up with both the first and second heaters, it is so often that the calibration processing is not yet terminated, and there is a case where the starting up of the fixing device 45 by both the first fixing heater 451 and the second fixing heater 452 ends up in vain. However, according to the above-described electric power control, the control portion 103 allows the first fixing heater 451 to heat the fixing roller 450 without allowing the second fixing heater 452 to heat the fixing roller 450 when a color image forming is performed. Accordingly, the electric power necessary for starting up the fixing 450 is reduced to be less than conventional amount without giving a user a stress caused by the waiting time during which the temperature of the fixing 450 reaches the predetermined fixing temperature. Further, since the number of times of charging and discharging the auxiliary power source is reduced, the life of the auxiliary power source can be extended to be longer than conventional life.

Further, when the determining portion 102 determines that the control information includes a monochromatic image forming instruction in S4 ("MONOCHROMATIC" in S4), the control portion 103 allows the commercial power source to supply electric power to the AC heater driving circuit 23 to allow the fixing roller 450 to heat the first fixing heater 451, and allows the discharging circuit 26 to perform electric power supply from the electric double layer capacitor 24 to the second fixing heater 452 (S8). Also in this case, the control portion 103 performs electric power control of S8 until the temperature information transmitted from the temperature detecting section 80 indicates the above-described fixing temperature (NO in S9). When the temperature information indicates the above-described fixing temperature (YES in S9), the control portion 103 allows the image forming unit 40 to form an image according to the received print data (S7). This provides an image forming executable state to a user promptly when a monochromatic image forming is performed requiring no calibration processing.

Figure 4:
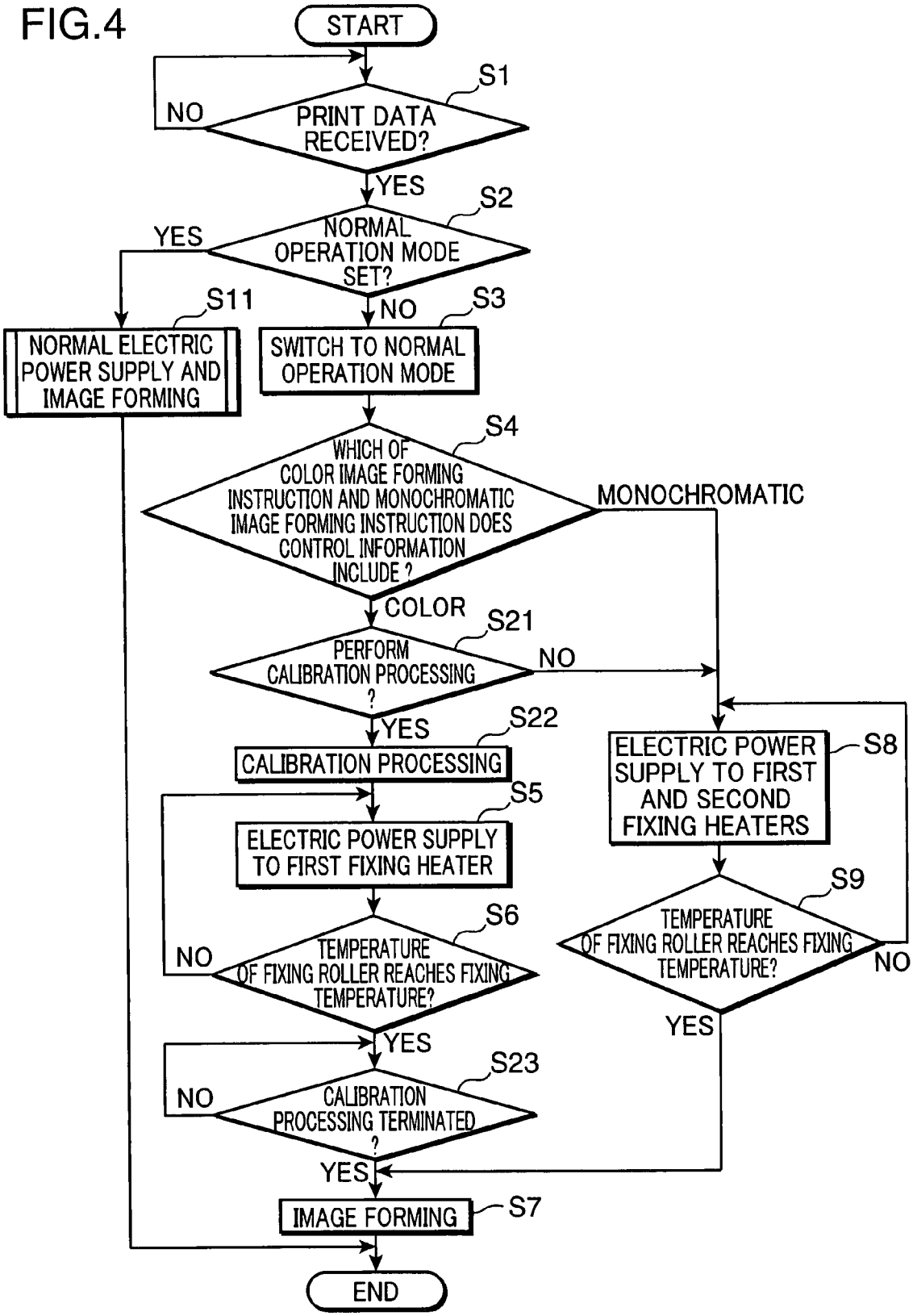
FIG. 4 is a flowchart showing a second embodiment of a control of electric power supply to the first fixing heater and the second fixing heater of the complex machine performed when the electric power saving mode is shifted to the normal operation mode.

Next, a second embodiment (other embodiment in a case of a printer operation) of control of electric power supply to the first fixing heater 451 and the second fixing heater 452 in the complex machine 1 at the time of shifting the electric power saving mode to the normal operation mode will be described. FIG. 4 is a flowchart showing a second embodiment of a control of electric power supply to the first fixing heater 451 and the second fixing heater 452 of the complex machine 1 performed when the electric power saving mode is shifted to the normal operation mode. The processings same as those in the first embodiment shown in FIG. 3 will be identified with the same reference numerals and descriptions of those will be omitted.

In the first embodiment, the control portion 103 does not allow the second fixing heater 452 to heat the fixing roller 450 but allows only the first fixing heater 451 to heat the fixing roller 450 when the determining portion 102 determines that a color image is formed ("COLOR" in S4 of FIG. 3). However, in the second embodiment, the control portion 103 allows both the first fixing heater 451 and the second fixing heater 452 to heat the fixing roller 450 when the color image forming is performed, and no calibration is performed.

In the second embodiment, when the determining portion 102 determines that the image forming unit 40 forms a color image ("COLOR in S4) after the processings of S1 through S3, the control portion 103 allows the commercial power source to supply electric power to the AC heater driving circuit 23 to allow only the first fixing heater 451 to heat the fixing roller 450 (S5) only if the control portion 103 allows the image forming unit 40 and an unillustrated patch pattern reading sensor and the like to drive to start the calibration processing (YES in S21, S22). The control portion 103 allows the first fixing heater 451 to terminate heating of the fixing roller 450 when the temperature of the fixing roller 450 reaches the predetermined fixing temperature (YES in S6). After the calibration processing is terminated, (YES in S23)

the control portion 103 allows the image forming unit 40 to form an image according to the print data (S7). When a timing of the temperature of the fixing roller 450 to reach the predetermined temperature becomes later than a timing of terminating the calibration processing, the control portion 103 allows the image forming unit 40 to form an image according to the print data at a point of time where the temperature of the fixing roller 450 reaches the predetermined fixing temperature.

On the other hand, when the determining portion 102 determines that the image forming unit 40 forms a color image in S4 ("COLOR" in S4) but no calibration processing is performed (NO in S21), the control portion 103, like the case of forming a monochromatic image, allows both the first fixing heater 451 and the second fixing heater 452 to heat the fixing roller 450 (S8).

In this control, only when a color image forming is performed without a calibration processing, and allowing both the first fixing heater 451 and the second fixing heater 452 heat the fixing roller 450 to start up the fixing device 45 in a short period of time achieves a prompt image forming, and the shortening of the time works effectively, both the first fixing heater 451 and the second fixing heater 452 heat the fixing roller 450. Accordingly, a situation where starting up of the fixing device 45 in a short period of time becomes effective will be determined accurately so that the fixing device 45 can be promptly started up without wasteful consumption of electric power of the electric double layer capacitor 24.

Figure 5:
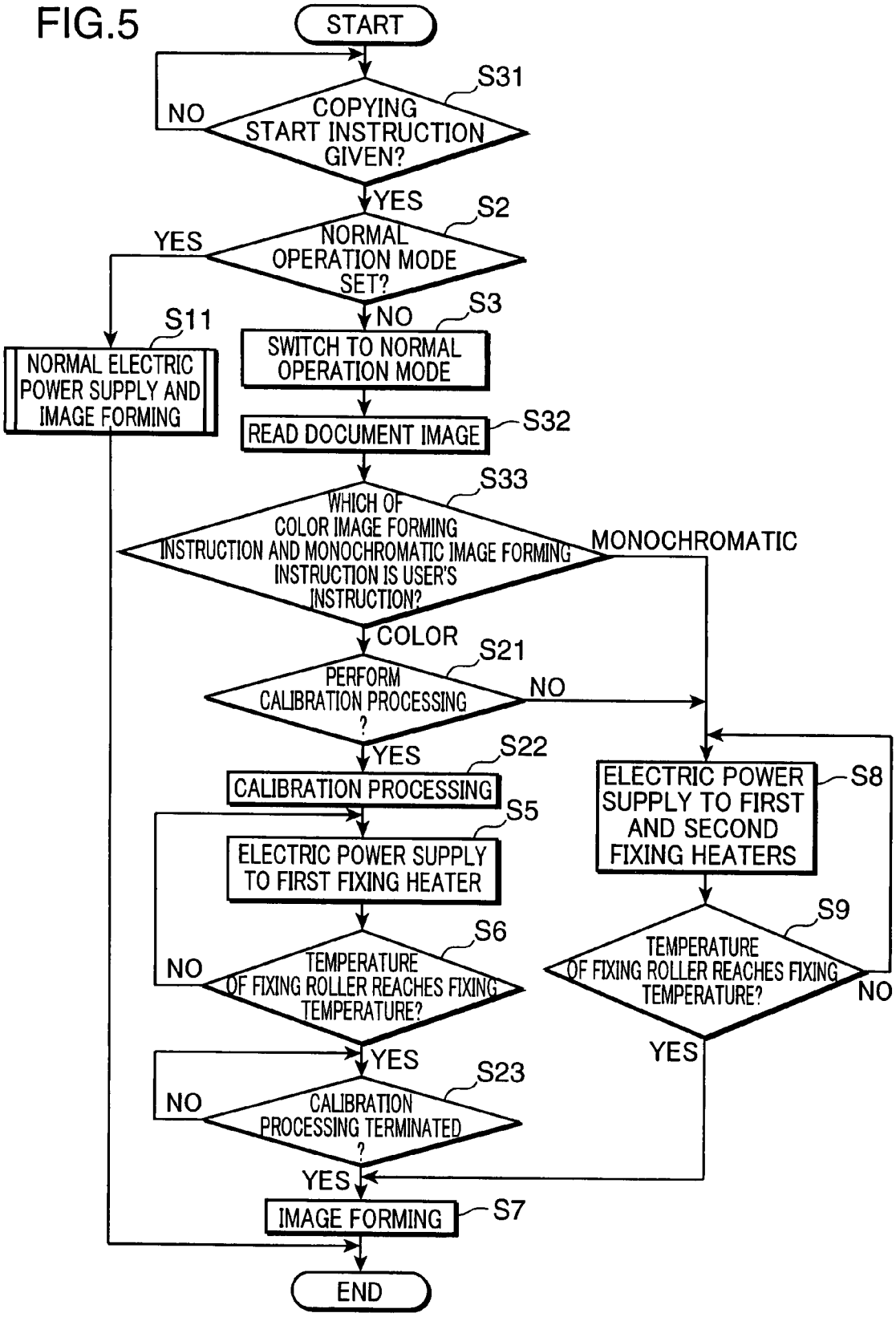
FIG. 5 is a flowchart showing a third embodiment of a control of electric power supply to the first fixing heater and the second fixing heater of the complex machine performed when the electric power saving mode is shifted to the normal operation mode.

Next, a third embodiment (in a case of a copying operation) of control of electric power supply to the first fixing heater 451 and the second fixing heater 452 in the complex machine 1 at the time of shifting the electric power saving mode to the normal operation mode will be described. FIG. 5 is a flowchart showing the third embodiment of a control of electric power supply to the first fixing heater 451 and the second fixing heater 452 of the complex machine 1 performed when the electric power saving mode is shifted to the normal operation mode. The processings which are the same as those of the first and second embodiments shown respectively in FIGS. 3 and 4 are identified with the same reference numerals, and descriptions of those will be omitted.

The above-described first and second embodiments show the electric power supply control to the first fixing heater 451 and the second fixing heater 452 in the case where the printer operation is performed in the complex machine 1. However, the third embodiment shows the electric power supply control to the first fixing heater 451 and the second fixing heater 452 in the case where a copying operation is performed in the complex machine 1.

In the complex machine 1, when a user operates the operating portion 47 to input a copying start instruction (YES in S31), and the control portion 103 determines that the operation mode is in the electric power saving mode (NO in S2), the mode setting portion 101 switches the operation mode to the normal operation mode (S3). Then, the control portion 103 allows the image reading section 5 to read a document image (S32). Next, the determining portion 102 determines which of a color image forming instruction and a monochromatic image forming the copying start instruction inputted by the user through the operating portion 47 in S31 is (S33). When the copying start instruction inputted by the user indicates a color image forming instruction, the determining portion 102 determines that the image forming unit 40 forms a color image ("COLOR" in S33). When the copying start instruction indicates a monochromatic image forming instruction, the determining portion 102 determines that the image forming unit 40 forms a monochromatic image ("MONOCHROMATIC" in S33).

According to this, it can be easily determined which of a color image and a monochromatic image is formed when a copying operation is performed in the complex machine 1.

It should be noted that the present invention is not limited to the above-described embodiments. For example, in the control of electric power supply to the first fixing heater 451 and the second fixing heater 452 at the time of printer operations shown in FIGS. 3 and 4, the determining portion 102 determines which of a color image forming and a monochromatic image forming is performed based on control information attached to the print data transmitted from a personal computer. However, not based on the control information, the print data received by the receiving portion 104 may be analyzed to determine which of a color image and a monochromatic image is formed based on which of a color data and a monochromatic data the print data indicates. Further, in the electric power supply control shown in FIG. 5, the determining portion 102 determines which of a color image and a monochromatic image is formed according to which of a color image forming and a monochromatic image forming the copying start instruction inputted by the user through the operating portion 47 in S31 is. However, it may be determined which of a color image forming and a monochromatic image forming is performed according to which of a color data and a monochromatic data the data of a document image read by the image reading section 5 indicates.

Further, in the above-described embodiments, the electric double layer capacitor 24 is described as an example of the auxiliary power source. However, the auxiliary power source may be replaced with an electricity storing mechanism (for example, a capacitor, a battery, and a lithium-ion battery) which can store electric power from the commercial power source and auxiliarily supply electric power to the fixing device 45 for heating the same. Furthermore, an image forming apparatus according to the present invention is not limited to the complex machine 1, but it may be other image forming apparatus. The configurations and processings shown in FIGS. 1 through 5 are mere embodiments of the present invention, and have no characteristic of limiting configurations and processings of the present invention to those.

In summary, the present invention includes an image forming apparatus comprising: an image forming section for forming a color image and a monochromatic image by providing a toner image to a recording sheet; a fixing section for fixing the toner image on the recording sheet at a predetermined fixing temperature, the fixing section being a part of the image forming section; a temperature detector for detecting a temperature of the fixing section; an auxiliary power source for auxiliarily supplying electric power to heat the fixing section, the auxiliary power source being charged with electric power supplied from a commercial power source; a heating portion for heating the fixing section, the heating portion including: a first fixing heater for heating the fixing section by electric power supplied from the commercial power source; and a second fixing heater for heating the fixing section by electric power supplied from the auxiliary power source; a determining section for determining which of a color image and a monochromatic image the image forming section forms; and a controller for controlling electric power supply to the heating portion. When the temperature of the fixing section detected by the temperature detector is less than the predetermined fixing temperature, the controller allows the auxiliary power source to stop supplying electric power to the second fixing heater and allows the commercial power source to supply electric power to the first fixing heater to heat the fixing section when the determining section determines that the image forming section forms a color image, and the controller allows the commercial power source to supply electric power to the first fixing heater to heat the fixing section and allows the auxiliary power source to supply electric power to the second fixing heater to heat the fixing section when the determining section determines that the image forming section forms a monochromatic image.

According to this invention, when a color image forming which requires a calibration processing takes a long processing time, and the calibration processing takes longer time than the time necessary for starting up the fixing section, supply of electric power to the first and second heaters to start up the fixing section in a short period of time becomes non-effective. Therefore, when forming a color image, the controller allows the first fixing heater to heat the fixing section without allowing the second fixing heater to heat the fixing section. Accordingly, the electric power necessary for starting up the fixing section is reduced to be less than conventional amount without giving a user a stress caused by the waiting time during which the temperature of the fixing section reaches the predetermined fixing temperature. Further, since the number of charging and discharging of the auxiliary power source is reduced, the life of the auxiliary power source can be extended to be longer than conventional life. On the other hand, when forming a monochromatic image without the calibration processing, the controller allows both the first and second heaters to start up the fixing section in a short period of time. Accordingly, an image forming executable state can be provided to a user promptly.

Further, according to the present invention, the controller allows the auxiliary power source to stop supplying electric power to the second fixing heater and allows the commercial power source to supply electric power to the first fixing heater to heat the fixing section when the temperature of the fixing section detected by the temperature detector is less than the predetermined fixing temperature and the determining section determines that the image forming section forms a color image, and a calibration is performed.

According to this invention, when a color image is performed, and the calibration processing is actually performed, the controller allows the commercial power source to supply electric power to only the first fixing heater to raise the temperature of the fixing section to the predetermined fixing temperature. Accordingly, a situation where starting up of the fixing section by driving of both the first and second fixing heaters in a short period of time becomes non-effective is determined accurately, and electric power supply to the second fixing heater is stopped. Accordingly, saving of electric power can be achieved.

Furthermore, according to the present invention, the controller allows the commercial power source to supply electric power to the first fixing heater to heat the fixing section and allows the auxiliary power source to supply electric power to the second fixing heater to heat the fixing section when the temperature of the fixing section detected by the temperature detector is less than the fixing temperature and the determining section determines that the image forming section forms a color image and no calibration is performed.

According to this invention, when a color image forming is performed, but no calibration processing is performed, the controller allows the commercial power source to supply electric power to the first fixing heater and allows the auxiliary power source to supply electric power to the second fixing heater to raise the temperature of the fixing section to the predetermined fixing temperature. Accordingly, even when forming a color image, a situation where starting up of the fixing section by driving of both the first and second fixing heaters in a short period of time becomes effective is determined accurately so that an image forming executable state can be provided to a user promptly in the state where the starting up in a short period of time is effective.

Further, the present invention further comprises a receiver for receiving print data from a network-connected computer. The image forming section forms a color image or a monochromatic image according to print data received by the receiver, and the determining section determines which of a color image and a monochromatic image the image forming section forms based on which of color image forming data and monochromatic image forming data the print data received by the receiver is.

According to this invention, the determining section determines which of a color image data and a monochromatic image data the print data received by the receiver based on the received print data. Accordingly, it can be determined which of a color image and a monochromatic image is formed without requiring a user to perform a special operation.

Further, the present invention further comprises further comprising a receiver for receiving print data and control information attached to the print data from a network-connected computer. The image forming section forms a color image or a monochromatic image according to the control information received by the receiver, and the determining section determines which of a color image and a monochromatic image the image forming section forms according to which of a color image forming instruction and a monochromatic image forming instruction the control information received by the receiver includes.

According to this invention, the determining section determines which of a color image and a monochromatic image the image forming section forms according to an image forming instruction included in the control information received along with the print data. Therefore, it can be easily determined which of a color image or a monochromatic image is formed.

Further, the present invention further comprises an image reader for reading a document image; and an instruction input section for allowing a user to input a color image instruction or a monochromatic image forming instruction. The determining section determines which of a color image and a monochromatic image the image forming section forms according to a detection of which of a color image forming instruction and a monochromatic image forming instruction an instruction inputted through the instruction input section is when the controller allows the image forming section to form an image of the document image read by the image reader.

According to this invention, when a document image read by the image reader is formed by the image forming section, the determining section determines which of a color image and a monochromatic image the image forming section forms according to an instruction inputted by the user through the instruction input section. Accordingly, when the image forming apparatus performs a copying operation, it can be easily determined which of a color image and a monochromatic image is formed.

Further, the present invention further comprises an image reader for reading a document image. The determining section determines which of a color image and a monochromatic image the image forming section forms according to a detection of which of a color image forming data and a monochromatic image forming data the image data read by the image reader is when the controller allows the image forming section to form an image of the document image read by the image reader.

According to this invention, the determining section detects which of a color image forming data and a monochromatic image forming data the image data read by the image reader is according to the read image data. Accordingly, it can be determined which of a color image and a monochromatic image is formed without requiring a user to perform a special operation.

This application is based on Japanese Patent application serial No. 2006-281659 filed in Japan Patent Office on Oct. 16, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image forming section for forming a color image and a monochromatic image by providing a toner image to a recording sheet;

a fixing section for fixing the toner image on the recording sheet at a predetermined fixing temperature, the fixing section being a part of the image forming section;

a temperature detector for detecting a temperature of the fixing section;

an auxiliary power source for auxiliarily supplying electric power to heat the fixing section, the auxiliary power source being charged with electric power supplied from a commercial power source;

a heating portion for heating the fixing section, the heating portion including:

a first fixing heater for heating the fixing section by electric power supplied from the commercial power source; and a second fixing heater for heating the fixing section by electric power supplied from the auxiliary power source;

a determining section for determining which of a color image and a monochromatic image the image forming section forms; and a controller for controlling electric power supply to the heating portion, wherein when the temperature of the fixing section detected by the temperature detector is less than the predetermined fixing temperature, the controller allows the auxiliary power source to stop supplying electric power to the second fixing heater and allows the commercial power source to supply electric power to the first fixing heater to heat the fixing section when the determining section determines that the image forming section forms a color image, and the controller allows the commercial power source to supply electric power to the first fixing heater to heat the fixing section and allows the auxiliary power source to supply electric power to the second fixing heater to heat the fixing section when the determining section determines that the image forming section forms a monochromatic image.

2. The image forming apparatus according to claim 1, wherein the controller allows the auxiliary power source to stop supplying electric power to the second fixing heater and allows the commercial power source to supply electric power to the first fixing heater to heat the fixing section when the temperature of the fixing section detected by the temperature detector is less than the predetermined fixing temperature and the determining section determines that the image forming section forms a color image, and a calibration is performed.

3. The image forming apparatus according to claim 2, wherein the controller allows the commercial power source to supply electric power to the first fixing heater to heat the fixing section and allows the auxiliary power source to supply electric power to the second fixing heater to heat the fixing section when the temperature of the fixing section detected by the temperature detector is less than the fixing temperature and the determining section determines that the image forming section forms a color image and no calibration is performed.

4. The image forming apparatus according to claim 1, wherein the controller allows the commercial power source to supply electric power to the first fixing heater to heat the fixing section and allows the auxiliary power source to supply electric power to the second fixing heater to heat the fixing section when the temperature of the fixing section detected by the temperature detector is less than the fixing temperature and the determining section determines that the image forming section forms a color image and no calibration is performed.

5. The image forming apparatus according to claim 1, further comprising a receiver for receiving print data from a network-connected computer, wherein the image forming section forms a color image or a monochromatic image according to print data received by the receiver, and the determining section determines which of a color image and a monochromatic image the image forming section forms based on which of color image forming data and monochromatic image forming data the print data received by the receiver is.

6. The image forming apparatus according to claim 1, further comprising a receiver for receiving print data and control information attached to the print data from a network-connected computer, wherein the image forming section forms a color image or a monochromatic image according to the control information received by the receiver, and the determining section determines which of a color image and a monochromatic image the image forming section forms according to which of a color image forming instruction and a monochromatic image forming instruction the control information received by the receiver includes.

7. The image forming apparatus according to claim 1, further comprising:

an image reader for reading a document image; and an instruction input section for allowing a user to input a color image instruction or a monochromatic image forming instruction, wherein the determining section determines which of a color image and a monochromatic image the image forming section forms according to a detection of which of a color image forming instruction and a monochromatic image forming instruction an instruction inputted through the instruction input section is when the controller allows the image forming section to form an image of the document image read by the image reader.

8. The image forming apparatus according to claim 1, further comprising an image reader for reading a document image, wherein the determining section determines which a color image and a monochromatic image the image forming section forms according to a detection of which of a color image forming data and a monochromatic image forming data the image data read by the image reader is when the controller allows the image forming section to form an image of the document image read by the image reader.

* * * * *